United States Patent [19]

Jonelis

[11] Patent Number: 4,478,614

[45] Date of Patent: Oct. 23, 1984

[54] ELECTROSTATIC PRECIPITATOR CONSTRUCTION HAVING SPACERS

[76] Inventor: John A. Jonelis, 304 Lancaster Dr., Crystal Lake, Ill. 60014

[21] Appl. No.: 446,775

[22] Filed: Dec. 3, 1982

[51] Int. Cl.[3] ..... B03C 3/47

[52] U.S. Cl. ..... 55/145; 55/154

[58] Field of Search ..... 55/143, 145, 154, 140, 55/112, 109, 440

[56] References Cited

U.S. PATENT DOCUMENTS

| | | | |
|---|---|---|---|
| 1,600,496 | 9/1926 | Weiskopf | 55/112 |
| 1,956,591 | 5/1934 | Gies | 55/440 X |
| 3,086,341 | 4/1963 | Brandt | 55/300 X |
| 3,490,210 | 1/1970 | Horton et al. | 55/440 |
| 3,530,645 | 9/1970 | De Lisio | 55/140 X |
| 3,553,939 | 1/1971 | Dyla | 55/112 |
| 3,805,496 | 4/1974 | Sokolowski | 55/440 |

FOREIGN PATENT DOCUMENTS

| | | | |
|---|---|---|---|
| 627192 | 9/1961 | Canada | 55/154 |
| 835012 | 5/1960 | United Kingdom | 55/109 |
| 1099342 | 1/1968 | United Kingdom | 55/140 |

*Primary Examiner*—Kathleen J. Prunner

*Attorney, Agent, or Firm*—Anthony S. Zummer

[57] ABSTRACT

The present invention relates to an improved construction for an electrostatic precipitator. The electrostatic precipitator collects solid particles carried by a flue gas from a source of combustion. The precipitator includes a plurality of spaced plates for collecting solid particles from the flue gas by electrostatic attraction of the solid particles to the plates. A plurality of elongated electrodes is positioned among the plates. Each of the electrodes is mounted between a pair of adjacent plates. Each of the electrodes is parallel to the other electrodes and is parallel to the plates. A plurality of identical spacers is positioned between adjacent plates to hold the plates in a flat attitude and to maintain adjacent surfaces of adjacent plates equidistantly spaced from one another. Each of the spacers is an elongated single unitary member and has one end fixed to a surface of one of a pair of adjacent surfaces of the plates and the other end abutting the other of the adjacent surfaces.

8 Claims, 9 Drawing Figures

FIG. 5
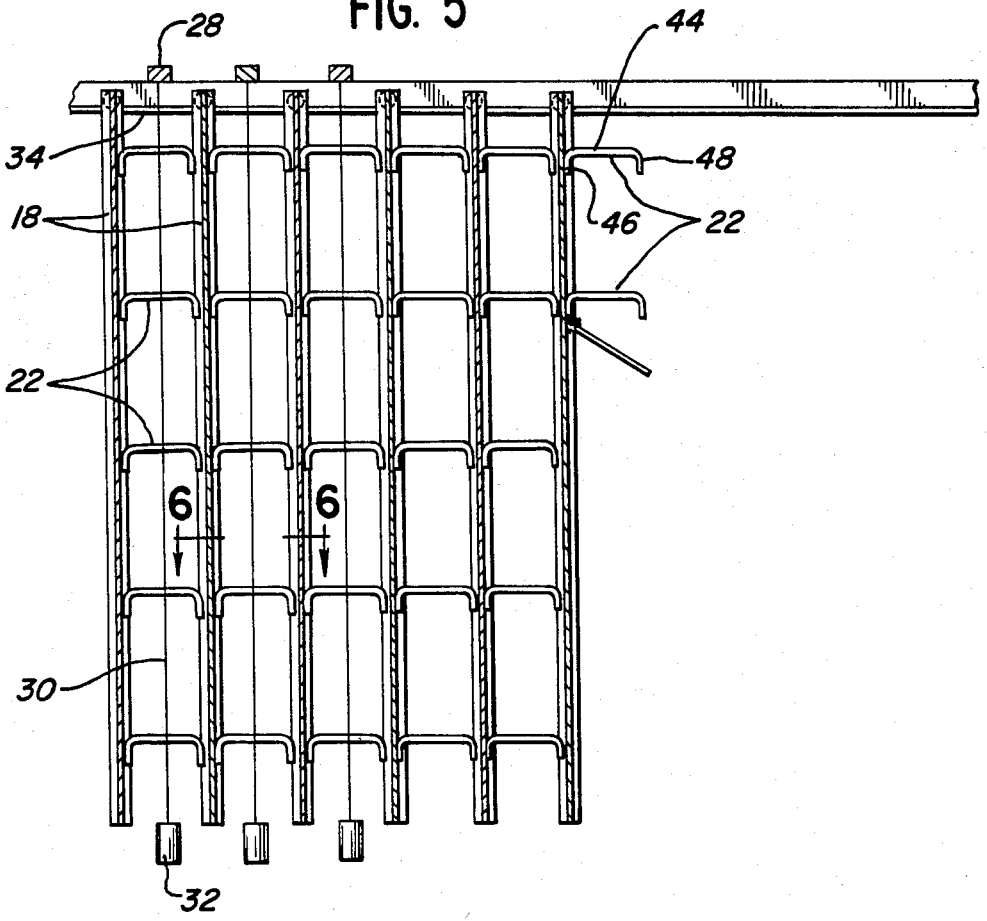
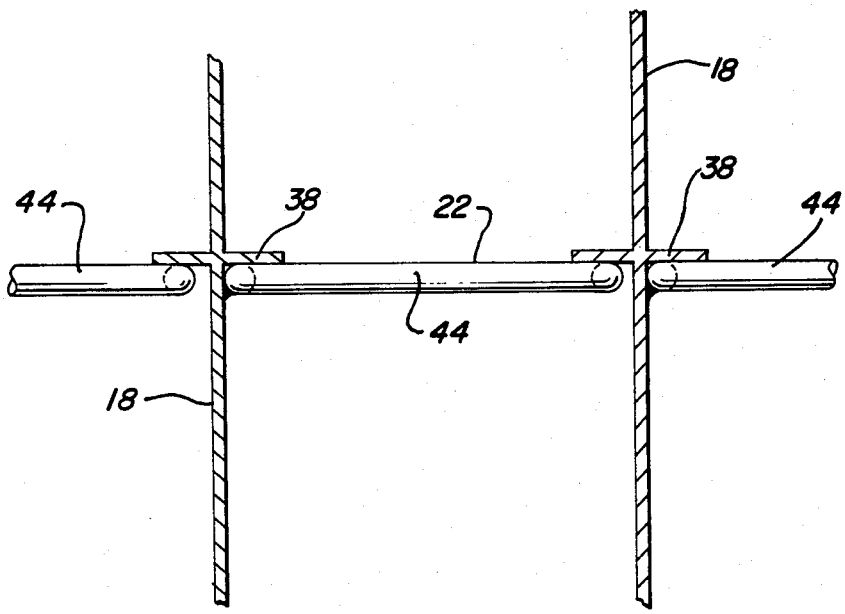
FIG. 6

FIG. 7
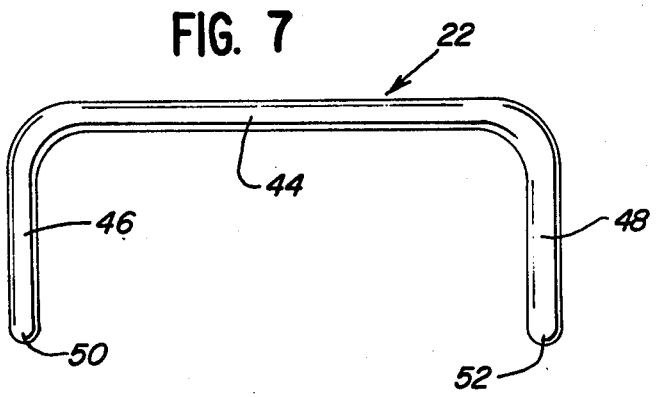
FIG. 8
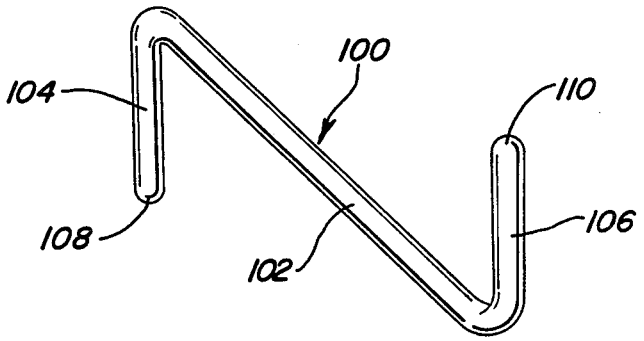
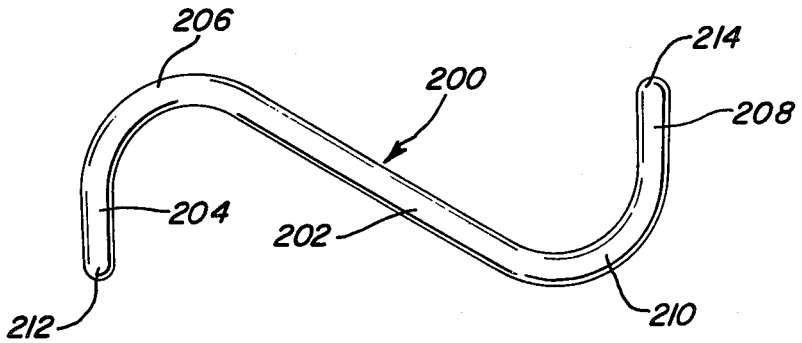
FIG. 9

ELECTROSTATIC PRECIPITATOR CONSTRUCTION HAVING SPACERS

BACKGROUND OF THE INVENTION

A commonly accepted practice of removing solid particles from a flue gas includes the utilization of an electrostatic precipitator to hold the solid particles without inhibiting the flow of the flue gas. Typically, an electrostatic precipitator is positioned in the flue between the outlet of a boiler and a smokestack.

The ordinary construction of an electrostatic precipitator includes a plurality of large, flat, metal plates which are spaced from each other. The metal plates may have a height of up to 30 feet or more, and a width of up to 10 feet or more. It is to be appreciated that the specific size of the plates in a given precipitator is dependent upon the particular precipitator construction for a given application. Ideally, the flat plates are equidistantly spaced from each other. A second plurality of elongated electrodes is positioned among the plates. The electrodes are positioned between each pair of adjacent plates. The elongated electrodes are equidistantly spaced from adjacent plates.

The uniform spacing of the elongated electrodes from the plates is necessary to have a uniform electrostatic charge between the elongated electrodes and the plates. A uniform electrostatic charge generates uniform collection of solid particles on the plates. Typically, the solid particles are removed from the plates by rapping the plates to vibrate the plates and, thereby, cause the collected solid particles to drop off of the plates in clusters into collectors under the plates.

The flue gas which enters the electrostatic precipitator is hot. Commonly, additional heat enters the precipitator in the form of fires caused by problems in the operation of the boiler. The continual exposure of the plates to heat causes the plates to warp or buckle. The warping or buckling of the plates destroys the uniform spacing between adjacent surfaces of adjacent plates and the uniformed spacing between each of the elongated electrodes and the respective adjacent plates. Thereby, the effectiveness of the precipitator in removing solid particles from flue gas is reduced so that the precipitator has a lower capacity. Consequently, the capacity of the boiler, which produces the flue gas, must also be lowered to comply with emissions regulations. In the case of a power generation unit, as the capacity of the boiler is reduced, the capacity of a power generating system connected to the boiler is also reduced. In order to maintain an electrostatic precipitator fully effective, it is desirable to maintain the spaced plates of the precipitator in an equidistantly spaced relationship to each other and to the electrodes.

One apparatus for holding electrostatic precipitator plates in an equidistantly spaced relationship is taught in U.S. Pat. No. 4,007,023, issued Feb. 8, 1977, to Batza et al, entitled "Electrostatic Precipitator With Collector-electrode Spacers." The Batza et al patent discloses a spacer construction for use between adjacent collecting electrode strips to hold the strips apart an equal distance from each other. Each spacer includes a bracket which is fixed to one of the strips. A spacer body is connected to the bracket by a pivot. A second bracket is fixed to a second electrode strip. The spacer body includes a slot for receiving the second bracket. The Batza et al device is expensive to manufacture and difficult to install, since the two brackets must be perfectly aligned on facing surfaces. Furthermore, the Batza spacer provides many sharp edges which create localized electrostatic charges to distort the electrostatic field around the strips thereby reducing the effectiveness of the electrostatic precipitator. Another known spacer is one which has an "H" bar construction. This spacer has a disadvantage in that the spacer is made up of three separate pieces which are welded together. In particular, it has been found that there is sufficient variation in size of the spacers to create a misalignment of the plates. The variation in size cannot be easily adapted in the field.

SUMMARY OF THE INVENTION

The subject of this invention is an electrostatic precipitator for collecting solid particles carried by a flue gas from a source of combustion. The precipitator includes a plurality of spaced parallel plates for collecting solid particles by electrostatic attraction of the solid particles to the plates. A second plurality of elongated electrodes is mounted between adjacent plates. Each of the elongated electrodes is parallel to the other electrodes and to the plates. The elongated electrodes are equidistantly spaced between the plates. A third plurality of identical spacers is positioned between adjacent plates to hold the plates in a flat attitude and to maintain adjacent surfaces of the plates equidistantly spaced from one another. Each of the spacers is a single unitary integral member. Each spacer has one end fixed to a surface of one of a pair of adjacent surfaces of a pair of plates and the other end abutting the other adjacent surface of the pair of plates.

BRIEF DESCRIPTION OF THE DRAWINGS

FIG. 5 is a side elevational view of a plurality of plates showing the attachment of the spacers to the plates;

FIG. 6 is an elongated cross sectional view taken on line 6—6 of FIG. 5;

FIG. 7 is a side elevational view of a "U" shaped spacer;

FIG. 8 is a side elevational view of a "Z" shaped spacer; and

FIG. 9 is a side elevational view of an "S" shaped spacer.

DESCRIPTION OF THE PREFERRED EMBODIMENT

Figure 1:
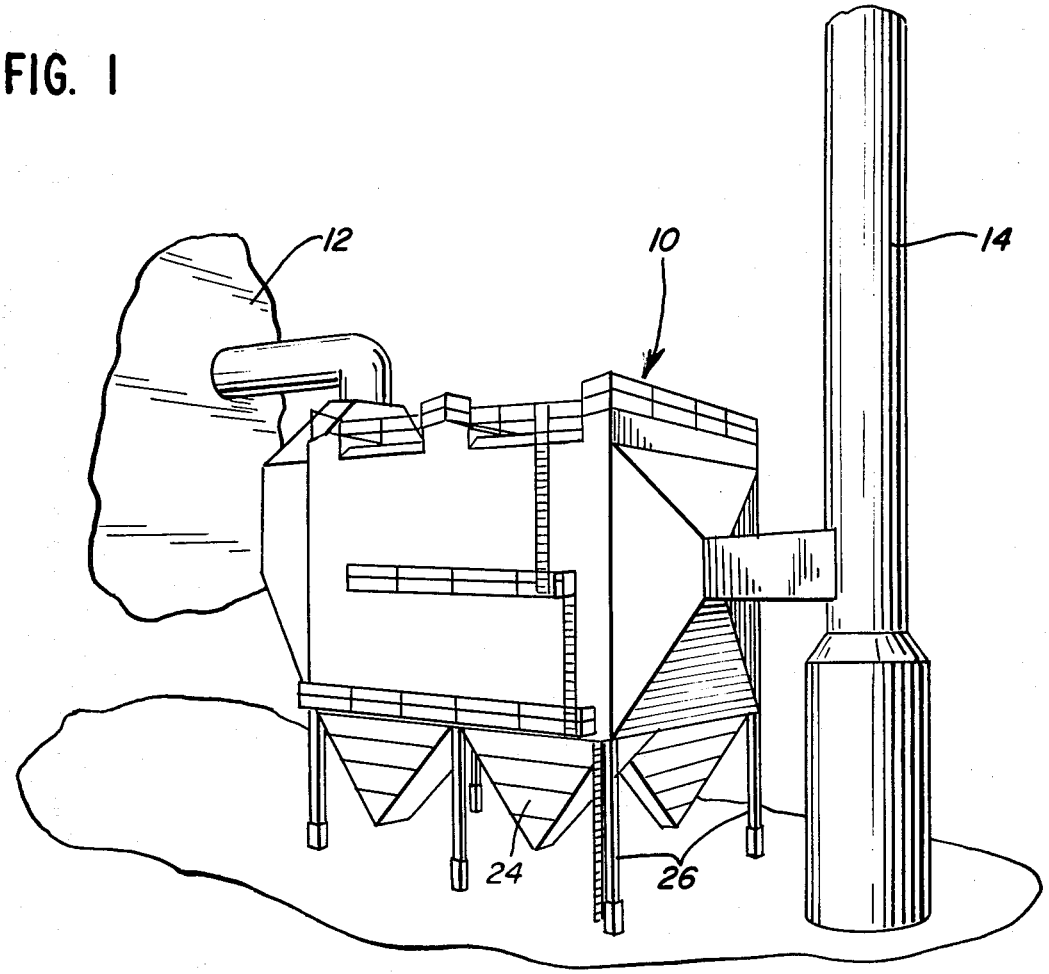
FIG. 1 is a perspective view of an electrostatic pecipitator embodying the herein described invention positioned between a boiler and a smokestack.
Figure 2:
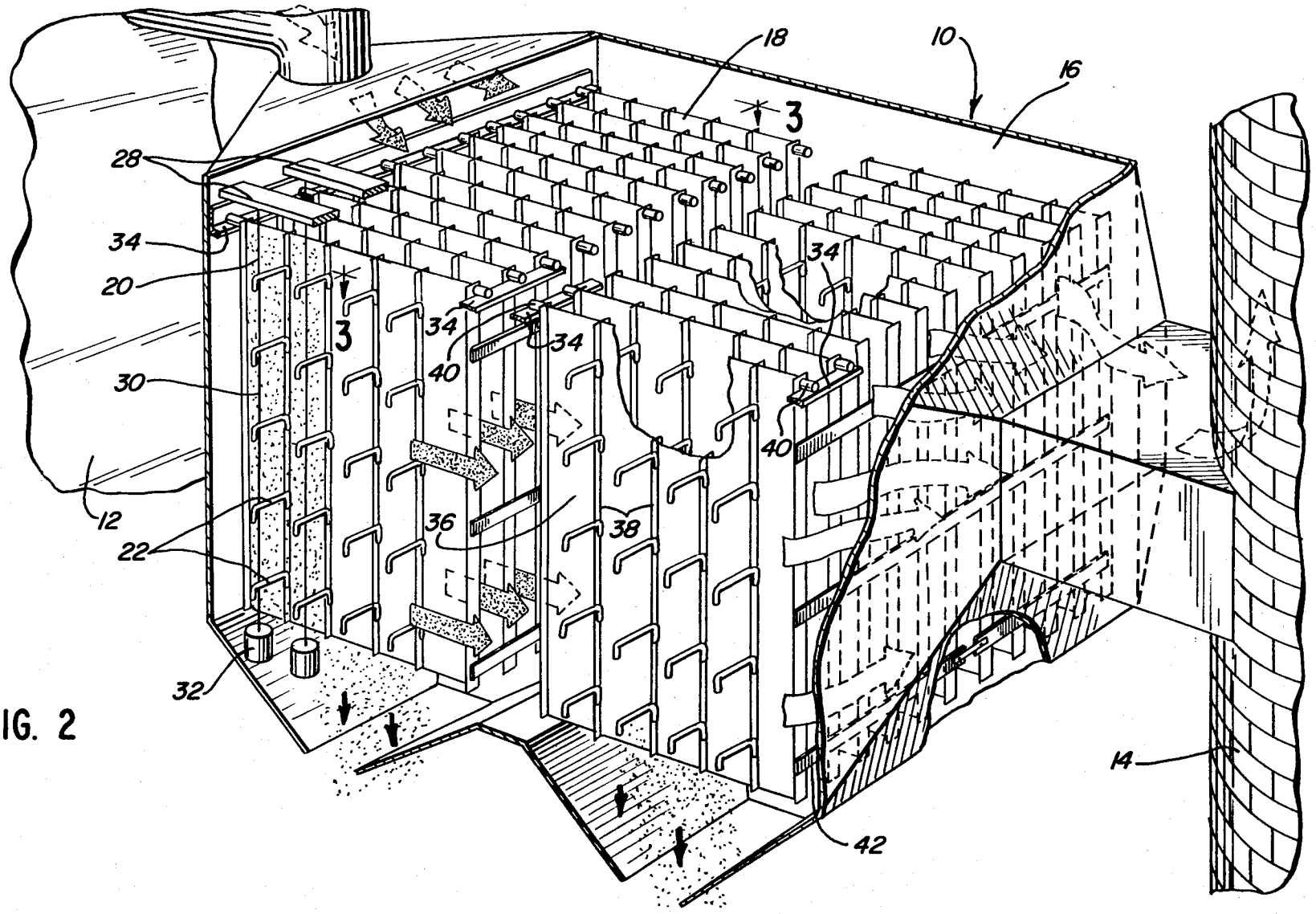
FIG. 2 is an enlarged fragmentary broken-away perspective view of the electrostatic precipitator shown in FIG. 1 showing a plurality of spaced plates and spacers attached to certain of the plates to maintain the plates in a uniform spaced relationship.

Referring now to the drawings and especially to FIG. 1, an electrostatic precipitator embodying the herein disclosed invention is generally indicated by numeral 10. The precipitator is mounted in a flue between a conventional boiler 12 and a conventional smokestack 14. Looking now to FIG. 2, it may be seen that the precipitator includes a housing 16 with a plurality of identical spaced flat metal plates 18 mounted in the housing. A second plurality of elongated electrodes 20 is positioned between the plates. A third plurality of spacers 22 is mounted on plates 18 to maintain the plates in a uniform spaced relationship and to flatten those plates which are warped or buckled.

Electrodes 20 and plates 18 are connected to a conventional source of an electrostatic charge which is not shown herein. As is well known in the art, the source of the electrostatic charge creates an electrostatic charge on the electrodes and an opposite electrostatic charge on the plates so that solid particles carried by the flue gas are attracted to plates 18. As is conventional, the cleansed flue gas then flows to smokestack 14.

The construction of the electrostatic precipitator is conventional in that the electrostatic precipitator housing 16 has its inlet connected to boiler 12. The housing is enclosed and has its outlet connected to smokestack 14. The bottom of housing 16 includes a plurality of collector hoppers 24, which are adapted to receive the solid particles which are collected on the plates. The hoppers are opened at their respective bottoms to discharge the collected solid particles from the housing. Housing 16 includes a plurality of legs 26 to support the precipitator.

A high tension frame 28 is mounted in housing 16. The frame 28 is conventional in its construction and is connected to the source of electrostatic charge. The elongated electrodes 20 are mounted on the frame 28. Each of the electrodes 28 is a single metallic electrically conductive wire 30 with a weight 32 secured to the end of the wire to hold the wire taut and perfectly perpendicular to the horizontal. Since each of the electrodes 20 is taut by its respective weight, all of the electrodes are parallel to each other. A lower high tension frame (not shown) restrains the wire weights in place to prevent movement. This frame is conventional in its design.

The precipitator includes a plurality of plate support rails 34 commonly known as anvil beams, mounted within housing 16. Plates 18 are mounted between adjacent rails 34. Each plate 18 includes a metallic electrically conductive collector surface 36 with a plurality of stiffeners 38 formed in the plate to make the plate rigid. A pair of ears 40 is fixed to the upper portion of each of the collector surfaces to provide a means for supporting the respective plate on rails 34. A plurality of side spacer bars 42 is secured to the ends of the plates to hold the plates in a selected spaced relationship relative to each other.

Figure 3:
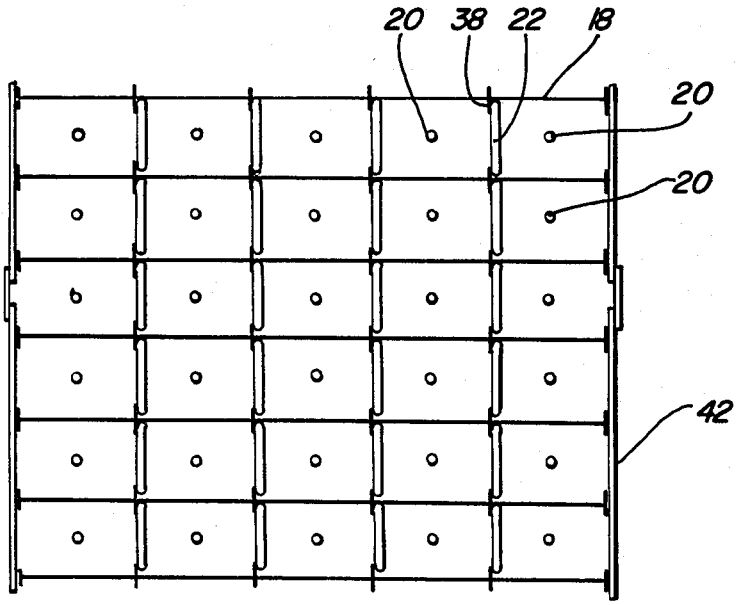
FIG. 3 is a plan view of a portion of the precipitator of FIG. 2 taken on line 3—3 of FIG. 2 showing the relative positioning of plates and elongated electrodes with spacers between adjacent plates.

As may be seen in FIG. 3, the plates are equidistantly spaced from each other and a plurality of electrodes is positioned between a pair of adjacent plates. The electrodes are equidistantly spaced between the plates.

In a new installation, the plates and electrodes are equidistantly and regularly spaced as shown in FIG. 3. However, after a prolonged usage of the precipitator, the plates tend to warp and buckle. The resulting disperity in the distance between adjacent plates and electrodes reduces the effectiveness of the precipitator. In order to bring the precipitator back to its original effectiveness and in some instances provide an improved capacity, spacers 22 are positioned between adjacent surfaces of adjacent plates to straighten the plates and to equalize the distance between adjacent surfaces of adjacent plates.

Referring now to FIG. 7, spacer 22 is shown therein. Spacer 22 is an integral elongated metal rod which is generally "U" shaped. Spacer 22 includes an elongated body 44 which as an end 46 formed integral therewith. End 46 is perpendicular to the longitudinal axis of body 44. Another end 48 is formed integral with the other end of body 44. End 48 is also perpendicular to the longitudinal axis of body 44. End 48 is parallel to end 46. End 46 has a rounded terminal portion 50. End 48 has a rounded terminal portion 52. The ends 46 and 48 and body 44 have the same circular cross section so that the spacer has a uniformed circular cross section along its entire length. The overall outside dimension from end 46 to end 48 is substantially equal to the distance between the adjacent sides of adjacent plates.

Figure 4:
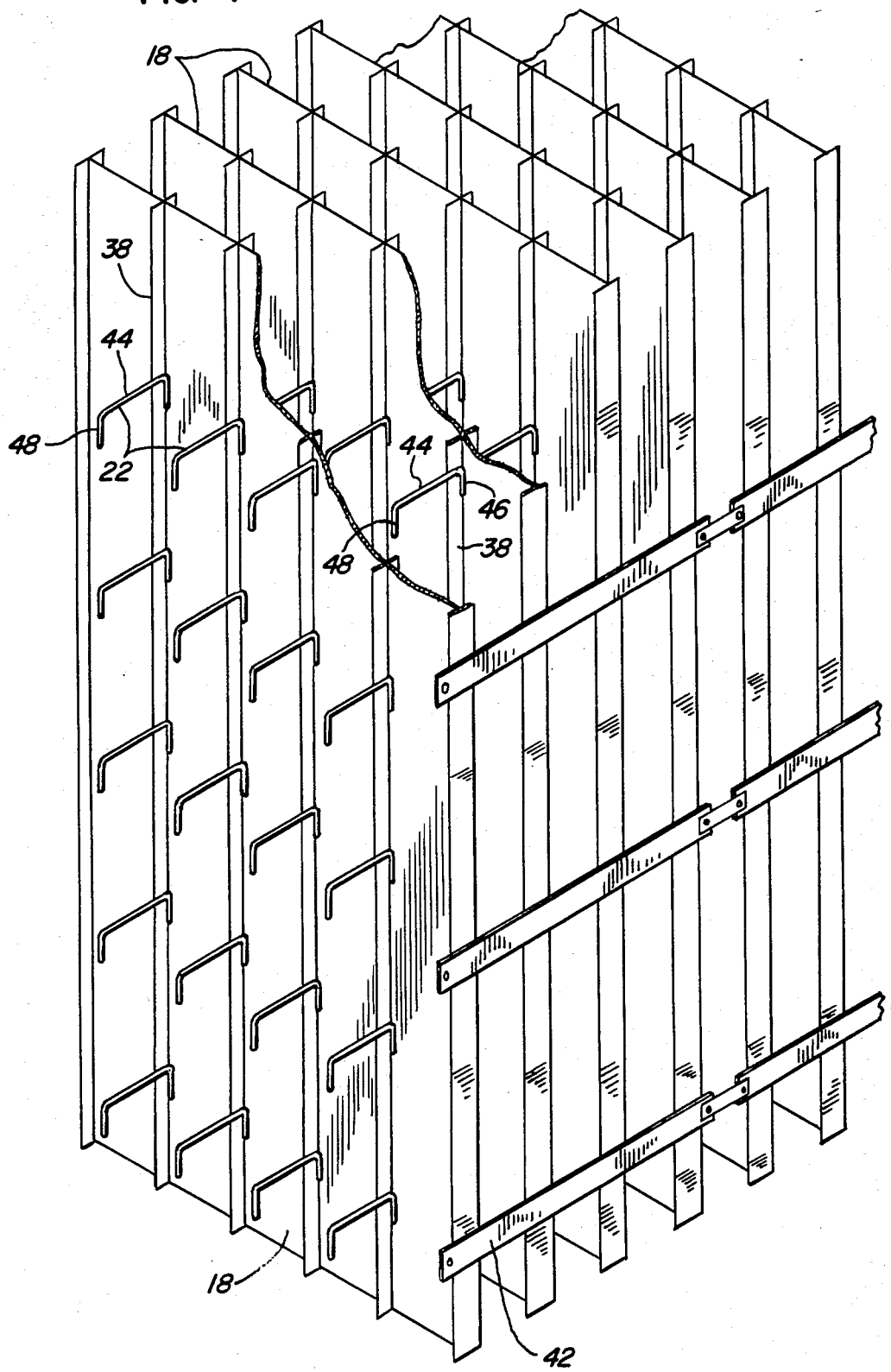
FIG. 4 is a fragmentary enlarged perspective view of a plurality of plates of the electrostatic precipitator of FIG. 2 showing spacers mounted between adjacent plates.

As is shown in FIG. 5, each of the spacers has one end, that is, end 46, welded to one side of a plate adjacent to a stiffener. The body of the spacer has its longitudinal axis perpendicular to the surface of the plate. Once all of the required spacers are secured to one side of a plate, the adjacent plate is then placed into engagement with the spacers. The adjacent plate is simply hung into position and gravity holds the plate generally upright so that the spacers abut the adjacent plate. In the event that the adjacent plate is warped so that the plate bows toward the spacers, the weight of the plate creates a moment which applies a force against the spacers to straighten the plate. Once the adjacent plate is positioned, additional spacers are mounted on the other side of that plate. The additional spacers which define another plurality of spacers are placed in line with the other spacers so that the lines of spacers are parallel to each other, as shown in FIGS. 3, 4, & 5. The positioning of the spacers in line means that the forces applied to each plate are at the stiffeners at the place where spacers are secured to the plate.

Positioning of a plurality of spacers on one plate provides a means for holding an adjacent plate a selected distance from the one plate even if one or both of the plates are warped or buckled. The weight of the plates causes the plates to be straightened by the spacers holding adjacent plates apart a set distance. The present construction has one end of each spacer fixed to a plate, but the other end is free to move relative to the abutting plates. The plates are thereby straightened when all of the plates are interconnected by the spacers.

Looking now to FIG. 8, a "Z" shaped spacer 100 is shown therein. The "Z" shaped spacer includes an elongated body 102, which has an end 104 formed integral therewith. Another end 106 is formed integral with the other end of the body and end 106 is parallel to end 104. End 104 has a rounded terminal portion 108, and end 106 has a like rounded terminal portion 110. Body 102 and ends 104 and 106 are in the same plane. The overall outside dimension from end 104 to end 106 is substantially equal to the distance between adjacent surfaces of a pair of plates. Spacer 100 is utilized in the same manner in which spacer 22 is used as described above. End 104 is welded to a surface of a plate while end 106 abuts an adjacent surface of an adjacent plate.

Looking now to FIG. 9, a spacer 200 is shown therein which spacer 200 is used in the same manner as spacer 22 as described above. Spacer 200 is generally "S" shaped and includes a body 202. An end 204 is formed integral with body 202 through a curved section 206. Another end 208 is formed integral with the other end of body 202 through a curved section 210. End 204 is parallel to end 208. Body 202 along with ends 204 and 208 and curved sections 206 and 210 are all in the same plane. End 204 has a rounded terminal 212, and end 208 has a like rounded terminal portion 214.

The construction of spacer 200 is such that the overall outside dimension from end 204 and end 208 is equal to the distance between adjacent surfaces of adjacent plates. End 204 is secured to a surface of a plate at a stiffener by welding the end to the plate while end 208 is allowed to abut the adjacent surface of the adjacent plate.

Both spacers 100 and 200 are made of a unitary rod having a uniform circular cross section so that the cross section of each of the spacers is uniform from end to end.

Each of the spacers 22, 100, and 200 has rounded terminal portions, and each spacer has a circular cross section. The spacers do no have any sharp edges to create a localized electrostatic charge between the plates.

Each of the spacers 22, 100, and 200 has a straight end portion which may be readily attached to a surface of a plate. Each spacer is attached to a plate by positioning the spacer at a selected location on the plate with the end in contact with the plate surface and a stiffener. The spacer end is welded to the plate surface. The spacer is substantially perpendicular to the surface of the plate. In view of the fact that each of the spacers has an overall length which is substantially equal to the distance between adjacent surfaces of adjacent plates, the free end of each of the spacers abuts the surface of the adjacent plate at a stiffener of the adjacent plate. As was mentioned above, the plates are forced into a flattened attitude making the distance between adjacent surfaces uniform. It follows that the equidistantly spaced portion of the elongated electrodes then provides a uniform position of the electrodes and plates. As flue gas flows between the plates and becomes charged from engagement with the electrodes, the solid particles are deposited upon the plates.

The instant invention is described in detail herein and shown in the accompanying drawings. It is readily apparent that those skilled in the art may make various modifications, and changes without departing from the spirit and scope of the present invention. It is to be expressly understood that the instant invention is limited only by the appended claims.

What is claimed is:

1. In an electrostatic precipitator for collecting solid particles carried by a flue gas from a source of combustion, said precipitator including a plurality of spaced parallel plates for collecting solid particles by electrostatic attraction of solid particles to the plates, each of said plates having a plurality of spatially arranged stiffeners projecting outwardly from opposite surfaces thereof, a plurality of elongated electrodes mounted between adjacent plates parallel to each other and parallel to the plates, the improvement comprising a plurality of spacers between adjacent plates to hold the plates in a flat attitude and maintain adjacent surfaces of the adjacent plates equidistantly spaced from one another, each of said spacers being elongated and having one end fixed to a surface of one of a pair of said adjacent surfaces adjacent to a stiffener and the other end abutting the other of the pair of the adjacent surfaces, and each of the spacers being a single unitary intergral member.

2. In an electrostatic precipitator for collecting solid particles carried by a flue gas from a source of combustion as defined in claim 1; wherein each spacer is a formed metal rod having a uniform cross section.

3. In an electrostatic precipitator for collecting solid particles carried by a flue gas from a source of combustion as defined in claim 1; wherein each spacer is a formed metal rod having a substantially uniform circular cross section and the ends of the rod are rounded.

4. In an electrostatic precipitator for collecting solid particles carried by a flue gas from a source of combustion as defined in claim 1; wherein each spacer is formed generally in the shape of a "U", and one end of the spacer is substantially parallel to the other end of the space.

5. In an electrostatic precipitator for collecting solid particles carried by a flue gas from a source of combustion as defined in claim 1; wherein each spacer is formed in the shape of a "Z", and one end of the spacer is substantially parallel to the other end of the spacer.

6. In an electrostatic precipitator for collecting solid particles carried by a flue gas from a source of combustion as defined in claim 1; wherein each spacer is formed generally in the shape of an "S".

7. In an electrostatic precipitator for collecting solid particles carried by a flue gas from a source of combustion as defined in claim 1; wherein each spacer is a formed metal rod having a substantially uniform circular cross section, one end of the spacer is substantially parallel to the other end of the spacer, and the terminal portion of each of the ends of the spacer is rounded.

8. In an electrostatic precipitator for collecting solid particles carried by a flue gas from a source of combustion as defined in claim 1; wherein the one end of each spacer is fixed to the surface of a plate by welding it to that surface of the plate.

* * * * *

UNITED STATES PATENT OFFICE

CERTIFICATE OF CORRECTION

PATENT NO. : 4,478,614

DATED : October 23, 1984

INVENTOR(S) : John A. Jonelis

It is certified that error appears in the above-identified patent and that said Letters Patent are hereby corrected as shown below:

Col. 2, Line 36, cancel "pecipitator" insert --precipitator--

Col. 4, Line 15, cancel "the"

Col. 5, Line 2, after "terminal" insert --portion--

Col. 6, Line 29, cancel "space" insert --spacer--

Signed and Sealed this

*Thirtieth* Day of *July 1985*

[SEAL]

*Attest:*

DONALD J. QUIGG

*Attesting Officer*

*Acting Commissioner of Patents and Trademarks*